United States Patent [19]

Gaucher

[11] Patent Number: 4,697,726

[45] Date of Patent: Oct. 6, 1987

[54] DEVICE FOR CUTTING A STRIP OF PAPER OR SIMILAR MATERIAL ALONG PREESTABLISHED TRANSVERSE LINES OF WEAKNESS

[75] Inventor: Michel M. Gaucher, Le Mesnil Saint Denis, France

[73] Assignee: Electronique Serge Dassault, Paris, France

[21] Appl. No.: 810,080

[22] Filed: Dec. 17, 1985

[30] Foreign Application Priority Data

Sep. 11, 1985 [FR] France ..... 85 13499

[51] Int. Cl.[4] ..... B65H 35/10

[52] U.S. Cl. ..... 225/100; 225/2; 225/5; 225/106

[58] Field of Search ..... 225/2, 100, 105, 106, 225/101, 5; 83/577

[56] References Cited

U.S. PATENT DOCUMENTS

| | | | |
|---|---|---|---|
| 2,331,351 | 10/1943 | Seeley | 225/105 |
| 2,513,093 | 6/1950 | Hageman | 225/100 |
| 2,618,336 | 11/1952 | Davidson | 225/100 X |
| 2,902,197 | 9/1959 | Potdevin et al. | 225/100 |
| 3,405,582 | 10/1968 | Eichenberger | 83/577 X |
| 3,644,932 | 2/1972 | Wallace et al. | 83/577 X |
| 3,794,228 | 2/1974 | Colwill et al. | 225/101 X |
| 4,529,114 | 7/1985 | Casper et al. | 225/100 |

FOREIGN PATENT DOCUMENTS

| | | | |
|---|---|---|---|
| 2404840 | 8/1975 | Fed. Rep. of Germany | 225/101 |
| 1022110 | 2/1953 | France | 225/105 |
| 144182 | 11/1981 | Japan | 225/105 |

OTHER PUBLICATIONS

Document Burster, IBM Technical Disclosure Bulletin, vol. 16, No. 6, pp. 1753, 1754, Nov. 1973.

*Primary Examiner*—Frank T. Yost

*Attorney, Agent, or Firm*—Christie, Parker & Hale

[57] ABSTRACT

A device for cutting a strip of paper or similar material, i.e. material in a flexible sheet which can be cut or torn easily, said strip having preestablished transverse lines of weakness. The strip is tensioned and then contacted with a blunt edged blade to tear the strip at the line of weakness.

8 Claims, 2 Drawing Figures

DEVICE FOR CUTTING A STRIP OF PAPER OR SIMILAR MATERIAL ALONG PREESTABLISHED TRANSVERSE LINES OF WEAKNESS

According to a known method, a sharp blade is moved transversely to the strip so that its cutting edge engages the strip, a supporting surface being provided on its side opposite to that which is struck by the blade. The strip is thus cut along a line lying in the plane of the blade, which may or may not coincide with the line of weakness. If it is desired that the two lines coincide, the strip position in the longitudinal direction must be defined precisely in relation with the blade plane, which requires complex and expensive positioning means.

The purpose of the invention is to obtain strip cutting along lines of weakness by simple and inexpensive means.

To this end, the device according to the invention comprises a substantially flat blade fitted with a leading edge for engaging the strip, drive means for submitting the blade to an alternating motion in its plane between two positions for which the leading edge is respectively extended and retracted, positioning means for positioning the strip to be cut so that it extends across the portion of the plane through which the leading edge sweeps with a line of weakness approximatively in the blade plane, while the edge is retracted, and to maintain it in its position, tensed in its longitudinal direction, while the leading edge is extended, said leading edge having a blunt profile and a concave form in the longitudinal direction so as to come into contact with the strip in a progressive manner from its sides towards its middle portion.

With this device, the blade does not cut the strip in its own plane, but tears it along the line of weakness, even if said line is several millimeters away from the blade plane.

Preferably, the edge profile is rounded, with a radius of curvature advantageously lying between 0.5 mm and 1.5 mm, and more precisely equal to about 0.8 mm. The longitudinal concave shape of the edge is for example V-shaped or arcuate.

According to a specific embodiment of the invention, the positioning means comprise motors suitable for acting on areas of the strip located on either side of the blade plane by urging said areas away from the said plane. Advantageously, these motors are stepper motors.

The invention also provides for the strip to be placed by the positioning means so that it goes through the blade plane substantially perpendicularly thereto.

The invention also relates to an installation for processing a strip of paper or similar material, comprising a cutting device with two motors and a strip feeder, the first of said motors whose action area is located between the feeder and the blade plane being suitable for pulling the strip from the feeder, and for putting it through the said plane until it is taken up by the second motor, and then for reversing against the action of the second motor, which second motor is suitable, after the strip has been cut, for advancing the cut off portion of strip for further processing.

The processing performed in the apparatus consists, for example, in printing and/or reading characters, and/or recording and/or reading data in magnetic form. Such an installation may be used particularly for issuing and/or processing and/or cancelling any kind of voucher, from transportation tickets, to payment documents such as checks.

Moreover, the invention concerns a method of cutting a strip of paper or similar material along preestablished transverse line of weakness, the method comprising the steps of tensing the strip longitudinally by pulling it in two opposite directions on either side of the line of weakness, moving a substantially flat blade, in its own plane, towards the strip, transversely to the strip, in the vicinity of the line of weakness, the blade having a blunt edge and being longitudinally concave in shape so as to engage the strip progressively from its sides toward its middle.

Other features and advantages of the invention will appear from the following detailed description and from the attached drawings, in which.

Figure 2:
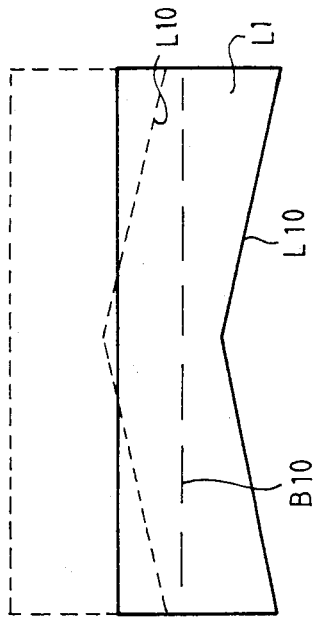
FIG. 2 is a partial view along F2 arrow of FIG. 1, at a larger scale.

The shown apparatus, which can be used to make check forms, comprises two paper strip feeders in the form of rolls B1 and B2 which can be used alternatively so as to ensure a continuous feeding of check forms.

The rolls B1 and B2 feed respectively two entrance deflectors D11 and D21. In the illustrated example, the rolls are positioned under the deflectors. However, it may be observed that roll feeding allows paper storage to be in any position relative to the rest of the apparatus.

The strip is inserted through two guide channels, which converge one towards each other, and which are fitted with separate drive means, constituted in this case by stepper motors MP1 and MP2. Detectors such as DD1 and DD2 determine if strip is inserted in each of the entrance channels. In an other embodiment of the invention, these detectors DD1 and DD2 can be replaced by detectors which are placed on the rolls B1 and B2 themselves, to determine if the end of strip supply is about to be reached.

A generally wedge-shaped piece, noted as C, defines one of the walls of each of the two aforesaid channels. The bottom of this piece defines in C11 and in C12 the top of the channel associated with the first roll B1. Between the two walls C11 and C12, and as it is shown on the drawing, a pulley G12 is provided which cooperates by friction with the pulley G11 which is fitted on the shaft of the stepper motor MP1. The bottom of the same channel is defined by a rectilinear extension of the deflector D11, facing the wall C11, and by an extension D12 of the same rectilinear part.

The second channel, which engages the roll B2, begins with the top wall C21 of the piece C, which lies in rectilinear extension of the deflector D21. Farther on, it is formed by a wall C22, and then by a wall C23. An upper guidance plate F21 fitted with an entrance lip is provided facing the wall C21. A pulley G22 is located between the guidance walls C21 and C22 to cooperate by friction with the pulley G21 which is fitted on the shaft of the stepper motor MP2. After this pair of pulleys, another upper guidance plate F22 is provided to form a guidance channel in cooperation with the walls C22 and C23.

The two paths or entrance channels converge between the guidance plate F22 check and the extension D12. Therefore, either of them can bring paper strip up to this point.

An electronic control unit, not shown, ensures that the stepper motors are controlled, as a function of the state of the detectors DD1 and DD2, so that only one channel brings strip to the aforesaid convergence point.

A deflector D31 and another deflector D32 located above the deflector D31 are fitted facing this convergence point in the forward direction of the strip coming from one of the rolls B1 and B2. These two deflectors converge towards the right of the drawing, i.e. in the aforesaid forward direction. The deflector D31 comprises a first plane part forming an angle with the deflector D32, which is itself plane, and the strip coming from the left abuts against said first plane part which is connected by a curved intermediate part to a plane terminal part at a smaller angle to the deflector D32 than the first plane part. The deflector D32 extends farther to the right than does the deflector D31.

A pulley G32 rigidly locked on the shaft of a stepper motor MP3 is located under the deflector D31. A notched belt CC1 engages the pulley G32, a pulley G33 fitted on the right of the deflector D32 and other pulleys not shown curving round the pulleys G32 and G33 and being tensed between them so that to be moved by the pulley G32 when the motor MP3 runs and to move in turn the pulley G33.

The belt CC1 passes over the pulley G32 and under the pulley G33, and its part comprised between these two pulleys passes under the converging ends of the deflectors D31 and D32. The plane of the deflector D32 intersects the surface of the pulley G33 and passes underneath its axis.

As a consequence of the disposition which has just been described, when the front end of a strip comes from the feed device, it is guided by the top face of the initial part of deflector D31 in the wedge-shaped space comprised between the deflector D31 and the deflector D32, then by the downstream end of the deflector D32 towards the surface of the pulley G33, and finally by the pulley G33 which is driven by the belt in the direction of arrow F1, towards the tangent line between the pulley G33 and the belt CC1, where the strip is gripped between these two items and driven toward the right by their movement.

When the feed device has fed a length of strip corresponding to the length of the piece to be cut off, the strip is cut by using a blade L1 fitted on the plunger EM10 of an electromagnet EM1.

The excitation of the electromagnet EM1 displaces the blade L1 downwards in its own plane, a return spring RE1 ensuring the reverse movement when the electromagnet is no longer excited. The position and the movement of the blade L1 are such that the piece of strip extending between the feed slide formed by the lip F23 and the extension D12, and the deflector D31 passes through the plane area swept by the lower or leading edge L10 of the blade L1, as shown in FIG. 2 where the blade in its down position is shown by a continuous line, and its up position is shown by a short dash line, with the line of the strip B10 in the blade plane being shown by a long dash line. The strip B10 is approximately perpendicular to the blade plane.

The leading edge L10 has a rounded profile, with a radius of curvature of 0.8 mm. In addition, the leading edge is longitudinally concave in shape, with the central part being set back from its end parts. In the shown example, the edge L10 is a symetrically V-shaped having an angle of approximatively 160°. An arcuate shape would be suitable as well.

Before being cut, the strip must be advanced, as previously described when the blade L1 is retracted. When the forward move is ended and a weakness line provided on the strip is located approximately in the blade plane, while still operating the stepper motor MP3 in the forward direction, the motor MP1 or the motor MP2 is then operated (depending on whether the strip comes from the roll B1 or from the roll B2), so that a force is applied against the strip, said force tending to return said strip to its roll. The strip is then stopped, being tensed in region of the plane of the blade L1.

Figure 1:
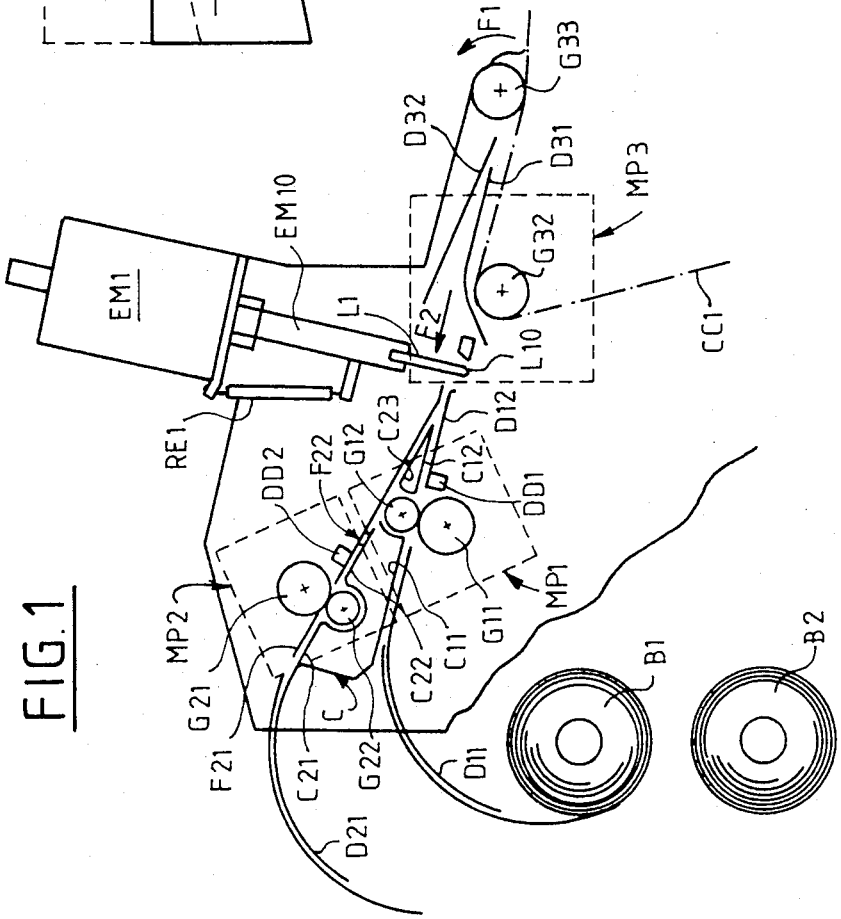
FIG. 1 is a partial schematic lateral view of a processing apparatus including a cutting device according to the invention.

While the stepper motors continue to be operated as described above, the electromagnet EM1 is excited, so that the blade is lowered towards its down position, as shown on FIG. 1. Because of its shape, the leading edge L10 first engages the sides of the strip. These are not retained by any support in the near vicinity of the blade and thus move down, and are tensed more and more until they tear at the place where the strip is least strong, i.e. at the line of weakness, regardless of whether it is in the blade plane. As the blade continues to move, the actions of thrust tension and rupture which are operated by the edge L10 spread progressively from the sides to the central part of the strip, which is thus torn across all of its width.

Once the cutting action is completed, the electromagnet is no longer excited, the spring RE1 retracts the blade to its upper position, and the entrance motor is no longer operated in the backwards direction. The motor MP3 moves the piece of strip which has just been cut off, through the galleys G32 and G33 and the belt CC1, toward the right for the subsequent processing. This processing includes printing characters, and, if so need, data recording in magnetic form, representing indications concerning an account and its owner, and also a check number, thereby completing the preprinted indications on the original strip which concern the bank which holds the account, in order to make a check form.

The processing also includes verification operations on the resulting check form. If the verification is satisfactory, the check is output by an exit from the apparatus (not shown). Otherwise, the motor MP3 is operated in the backwards direction, which returns the piece of strip along the path it has just followed in the apparatus up to the pulley G33, where it is engaged under the deflector D31 and on the pulley G32 to be rejected.

When the processed piece of strip has left the track defined by the belt CC1, in one way or the other, and if another check is requested, the entrance motor MP1 or MP2 is operated again to bring the remaining strip toward the deflector D31, and the above-described operations are repeated.

Naturally, the invention is not limited to the embodiment described. In particular, the device according to the invention can be used for purposes other than check form making. For example, it could be included in an apparatus to make strips indicating flight schedules for air navigation as described in French Pat. No. 84 10379 dated June 26, 1984, to replace of the guillotine provided in this Patent, provided such apparatus is fed with strips bearing lines of weakness.

Furthermore, the invention may be combined with the subject matter of French Patent Applications filed this day under the Applicant's name, No. 85 13497 named "Automatic distributor for banknotes" and No. 85 13498 named "Apparatus usable as an automatic banking paydesk for check withdrawal or deposit".

The invention may be operated with strips presenting lines of weakness made in various ways, for example with one or several notches extending through a portion of the thickness of the strip and along all or a part of its width, or with perforations going through the thickness of the strip and spaced across to its width.

More particularly, the invention applies to the paper strips which are stocked in fan-fold form, as is used for data processing listing paper.

The mechanism situated downstream from the pulley G33 may define with the belt CC1 an internal track for the processing of vouchers of different natures, for example as described in the Applicant's French Patent Application No. 75 37 475, published under No. 2,334,501; French patent application No. 83 11444, published under No. 2,548,804 upon which priority is claimed in U.S. Pat. No. 4,537,125; French patent application No. 84 10378, published under No. 2,566,941, priority of which is claimed in U.S. patent application Ser. No. 672,184 filed on Nov. 16, 1984; French patent application No. 84 10379, published under No. 2,566,704; French patent application No. 84 10380, published under No. 2,566,705, priority of which is claimed in U.S. patent application Ser. No. 672,185 filed on Nov. 16, 1984; French patent application No. 85 01661 and French patent application No. 85 05894, said No. 85 01661 corresponding to U.S. patent application Ser. No. 810,079 filed Dec. 17, 1985 and No. 85 05894 corresponding to U.S. application Ser. No. 810,056 filed Dec. 17, 1985.

We claim:

1. Apparatus for cutting a strip of paper or similar material along preestablished transverse lines of weakness comprising:

an approximately planar blade having a leading edge for engaging the strip;

drive means for reciprocally displacing the blade along its plane between two positions in which the leading edge of the blade is either retracted from the strip or moved forward to sever the strip;

a strip feeder for feeding the strip toward the blade;

positioning means for moving the strip while the blade is in the retracted position so the strip extends across the plane swept by the leading edge of the blade, with a line of weakness on the strip extending approximately in the plane of the blade, the positioning means also being adapted to hold a portion of the strip in tension in the longitudinal direction while the leading edge of the blade is moved to its forward position for severing the strip transversely along or in proximity to the line of weakness;

the positioning means including a pair of stepper motors arranged to act on areas of the strip positioned on opposite sides of the planar blade, a first one of the stepper motors being located between the strip feeder and the plane of the blade for pulling the strip from the feeder and passing it across the plane until the strip is taken up by the second stepper motor which is arranged for moving the strip away from said plane, the first stepper motor having means for thereafter urging the strip in an opposite direction against the action of the second motor to apply said tension to said portion of the strip and to also hold said portion of the strip stationary;

the leading edge of the blade having a blunt profile and a longitudinally concave shape for engaging the tensioned and stationary portion of the strip progressively from the sides toward the middle as the blade is moved toward its forward position for severing the strip;

the second motor being arranged for advancing the cutoff portion of the strip for further processing after a strip has been severed.

2. Apparatus according to claim 1, characterized by the fact that the profile of the leading edge is rounded.

3. Apparatus according to claim 2, characterized by the fact that the leading edge is V-shaped.

4. Apparatus according to claim 1, characterized by the fact that the strip feeder is suitable for receiving fan-folded strip.

5. Apparatus according to claim 1, 2 or 3, characterized in that the blade drive means include an electromagnet.

6. Apparatus according to claim 1, 2 or 3, characterized in that the blade drive means include a return spring.

7. Apparatus according to claim 1, 2 or 3, characterized in that the positioning means are arranged for positioning the strip so that the blade plane passes approximately perpendicularly to the strip.

8. Apparatus according to claim 1, characterized by the fact that said motors are stepper motors.

* * * * *